United States Patent [19]

Wasserman et al.

[11] 3,994,895

[45] Nov. 30, 1976

[54] PRODUCT AND PROCESS FOR PROTECTING SPLIT LINE OF A MOVABLE NOZZLE

[75] Inventors: Bernard Wasserman; Frederick A. Emerson, Jr., both of China Lake; William H. Thielbahr, Ridgecrest, all of Calif.

[73] Assignee: The United States of America as represented by the Secretary of the Navy, Washington, D.C.

[22] Filed: Oct. 21, 1974

[21] Appl. No.: 516,291

[52] U.S. Cl. ..... 252/28; 60/232; 260/33.6 F; 260/42.27

[51] Int. Cl.[2] ..... C10M 7/28

[58] Field of Search ..... 260/33.6 F, 42.27, 897 C; 252/28

[56] References Cited

UNITED STATES PATENTS

| | | | |
|---|---|---|---|
| 2,719,833 | 10/1955 | Vincent et al. | 260/33.6 F |
| 3,125,547 | 3/1964 | Blatz | 260/897 C |
| 3,334,157 | 8/1967 | Larsen | 260/897 C |

*Primary Examiner*—James H. Derrington
*Attorney, Agent, or Firm*—R. S. Sciascia; Roy Miller; Lloyd E. K. Pohl

[57] ABSTRACT

Compositions consisting essentially of about 1 weight percent carbon black, from about 20 to about 35 weight percent polytetrafluoroethylene and from about 79 to about 64 weight percent of a material selected from the group consisting of isobutylene-isoprene copolymer and ethylene-propylene rubber are disclosed as being useful as protective fillers in situations where the protective filler is subjected to high temperatures and pressures.

2 Claims, No Drawings

PRODUCT AND PROCESS FOR PROTECTING SPLIT LINE OF A MOVABLE NOZZLE

BACKGROUND OF THE INVENTION

1. Field of the Invention.

This invention relates to protective fillers. More specifically, this invention relates to formulations which are useful as protective fillers in the splitline area of a gimbaled rocket motor.

2. Description of the Prior Art.

In a rocket motor wherein the nozzle is gimbaled to provide thrust vector control the nozzle portion of the motor is affixed to a movable housing which (when the nozzle is moved) rotates within a fixed motor housing insulation. The movable housing resembles a ball with an opening through it. Hot gases from burning propellant within the motor pass through the opening in the ball-like movable housing. Between the outer circumference of the ball-like movable housing and the inner surface of the fixed motor housing insulation is a gap of variable width. This gap is known in the art as a splitline. The splitline is necessary to allow the ball-like movable housing to rotate freely and thus permit thrust vector control.

Since hot gases from the burning propellant tend to exhaust from the rocket motor through any available opening and tend to damage the outer surface of the movable housing the splitline is packed with a filler. The filler serves two purposes. It protects the outer surface of the ball-like movable housing from the effects of heat and pressure and it, along with other suitably placed devices such as O-rings, acts to insure that exhausting gases will exhaust through the opening in the movable housing where they are supposed to.

The splitline filler then must have certain properties. It must be heat resistant. That is, it must be able to withstand the tremendous heat provided by the hot exhaust gases which it comes in contact with. Yet, it must have a low enough thermal diffusivity to insulate effectively. It must be non-abrasive. That is, since it is in contact with both the movable housing and the fixed motor insulation, its properties must be such that it does not cause friction. When it does burn, it must burn in a manner whereby no abrasive residue is left upon completion of burning. (It is permissible for a portion of the filler to burn away during flight.) And finally, it (that portion that doesn't burn away during flight) must stay in the splitline during flight. That is, its properties must be such that pressures to which it is subjected do not cause it to be mechanically removed from the splitline.

In the prior art a material known as brown zinc chromate putty (procured under military specification MIL-P-8116B) has been predominently if not exclusively used as splitline filler. Brown zinc chromate putty has a drawback in that when it burns it leaves an abrasive residue. Therefore, it is the primary objective of this invention to provide splitline filler formulations which are superior to brown zinc chromate putty. It is a further objective of this invention to provide formulations for use as protective fillers in any other situation where thermal stability and resistance to pressure are necessary.

SUMMARY OF THE INVENTION

Two new splitline filler formulations are disclosed herein. One formulation comprises isobutylene-isoprene copolymer, Teflon (polytetrafluoroethylene) and carbon black and the other comprises ethylene-propylene rubber, Teflon and carbon black.

DESCRIPTION OF THE PREFERRED EMBODIMENTS

Several formulations, among which were the formulations described and claimed herein, were made up and subjected to certain hereinafter described tests. Brown zinc chromate putty, the currently used splitline filler, was subjected to the same tests for comparative purposes.

Of the formulations made up, one containing 74 weight percent of a isobutylene-isoprene copolymer having an average molecular weight of about 30,000, 25 weight percent polytetrafluoroethylene, and 1 weight percent carbon black and one containing 74 weight percent ethylene-propylene rubber, 25 weight percent polytetrafluoroethylene and 1 weight percent carbon black provided the best results when compared wth brown zinc chromate putty in the hereinafter described tests. These formulations were made up by treating the various ingredients on a rubber mill to render them suitable for packing into the various components of the test apparatus (or into the splitline of a gimbaled rocket motor).

One of the tests to which the formulations and brown zinc chromate putty were subjected was called a pressure blowout test. The pressure blowout test measures the pressure required to expel the formulation through a stainless steel tube 2 inches long and 1/16 inch inside diameter. The formulation is placed in the tube and the tube is placed in a device which enables the investigator to increase pressure until the formulation extrudes or is rapidly expelled from the tube. Brown zinc chromate putty and the above described formulation of isobutylene-isoprene copolymer, polytetrafluoroethylene and carbon black both showed partial extrusion at 1150 psi. The above described formulation of ethylene-propylene rubber, polytetrafluoroethylene and carbon black showed no movement at 1150 psi.

Another test to which the formulations were subjected was called the plasma arc test. The object of the plasma arc test was to obtain information on the resistance of the formulations to aerodynamic shear loads under hot conditions similar to those experienced in a splitline. Specimens of the formulations were placed between 3/8 inch thick micarta blocks shimmed to provide a gap of 0.05 inch (similar to a splitline gap) and means were provided to hold the specimens rigidly in place. The specimens were then subjected to high heat flux argon plasma (about 100 BTU/ft$^2$ — sec) for 5 seconds. The specimen, in each case, was placed 0.5 inch from the plasma nozzle. Of several formulations tested, formulations made up of isobutulene-isoprene copolymer, polytetrafluoroethylene and carbon black and formulations made up of ethylene-propylene rubber, polytetrafluoroethylene and carbon black best resisted the plasma being somewhat better than brown zinc chromate putty. Erosion, after 5 seconds was 10 mils in formulations made up of isobutylene-isoprene copolymer, polytetrafluoroethylene and carbon black and formulations made up of ethylene-propylene rubber, polytetrafluoroethylene and carbon black and 20 mils in brown zinc chromate putty.

Another test to which the formulations were subjected was called a thermogravimetric analysis. Thermogravimetric analysis is performed by heating a specimen at a constant rate and determining weight loss as a function of temperature. After heating to 350° C at a rate of 5° C/min., made up of isobutylene-isoprene copolymer, polytetrafluoroethylene and carbon black exhibited a 20 percent weight loss. Brown zinc chromate putty and formulations made up of ethylene-propylene rubber, polytetrafluoroethylene and carbon black exhibited identical 7 percent weight losses. It should be mentioned here that neither of the formulations of this invention left a residue while brown zinc chromate putty did.

The foregoing description has been made with respect to formulations containing 74 weight percent isobutylene-isoprene copolymer or ethylenel-propylene rubber, 25 weight percent polytetrafluoroethylene and 1 weight percent carbon black. These weight percentages can be varied somewhat. For example, that of the isobutylene-isoprene copolymer or ethylene-propylene rubber can be varied as much as ± 15% with a corresponding variance in the polytetrafluoroethylene weight percentage (to keep the total for the formulation 100) with no adverse results.

The foregoing description has been made with reference to splitline protection. That is, the tests were carried out with the idea in mind that the formulations being tested were candidates for use in splitline protection. It will be obvious to those skilled in the art that formulations according to this invention are useful in many other applications where the protective formulation is subjected to high temperatures and pressures.

What is claimed is:

1. As a composition of matter, a formulation consisting essentially of about 1 weight percent carbon black, from about 20 to about 35 weight percent polytetrafluorethylene and from about 79 to about 64 weight percent of a material selected from the group consisting of isobotylene-isoporene copolymer having an average molecular weight of about 30,000 and ethylene-propylene rubber.

2. A composition of matter consisting essentially of about 1 weight percent carbon black, from about 20 to about 35 weight percent ethylene-propylene rubber.

* * * * *